US007513208B1

(12) United States Patent
Seaman et al.

(10) Patent No.: US 7,513,208 B1
(45) Date of Patent: Apr. 7, 2009

(54) DISCONNECTABLE MOORING SYSTEM WITH VESSEL-MOUNTED TENSIONING DEVICE

(75) Inventors: David M. Seaman, Waller, TX (US); Gordon E. Nettles, Jr., Houston, TX (US)

(73) Assignee: SOFEC, Inc., Houston, TX (US)

( * ) Notice: Subject to any disclaimer, the term of this patent is extended or adjusted under 35 U.S.C. 154(b) by 0 days.

(21) Appl. No.: 11/874,099

(22) Filed: Oct. 17, 2007

(51) Int. Cl.
*B63B 21/00* (2006.01)
*B63B 22/02* (2006.01)

(52) U.S. Cl. ..... 114/230.12; 114/230.22; 441/5

(58) Field of Classification Search ..... 441/3–5; 114/230.12, 230.13, 230.2, 230.22; 405/169, 405/195.1, 202, 224, 224.2
See application file for complete search history.

(56) References Cited

U.S. PATENT DOCUMENTS 4,436,048 A * 3/1984 Gentry et al. ..... 114/230.12
4,448,568 A * 5/1984 Gentry et al. ..... 405/168.3
5,240,446 A * 8/1993 Boatman et al. ..... 441/3
5,292,271 A * 3/1994 Boatman et al. ..... 441/3
5,306,186 A * 4/1994 Boatman ..... 441/4
5,316,509 A * 5/1994 Boatman et al. ..... 441/3
5,356,321 A * 10/1994 Boatman et al. ..... 441/3
5,372,531 A * 12/1994 Boatman et al. ..... 441/4
6,564,740 B1 * 5/2003 Hobdy et al. ..... 114/230.12

* cited by examiner

*Primary Examiner*—Daniel V Venne
(74) *Attorney, Agent, or Firm*—Gary L. Bush; Mark D. Shelley II; Andrews Kurth LLP

(57) ABSTRACT

A buoy recovery system for a disconnectable mooring arrangement that permits turret-buoy connection at any compass heading while preventing damage to the pull-in line and the turret assembly. In a preferred embodiment, the mooring tensioning assembly is positioned on the vessel at a location other than on the rotatable turret assembly. This permits the size of the turret assembly to be significantly reduced and the fluid swivel stack to be positioned within the vessel between its deck and keel. The improved buoy recovery system employs a hollow bore hydraulic cylinder assembly that is attached to the turret assembly and configured as a chain tensioning system. The hollow bore hydraulic cylinder assembly is arranged and designed to support the weight of the buoy and permit the turret assembly to be rotated relative to both the vessel and the buoy during mooring operations.

23 Claims, 4 Drawing Sheets

242
220
233
219
280
257
243
247
258
245
244
223
282
254
248
237
292
290
241
239
270
230
235
240
246
256
252
251
255
253
250
221
249
228

DISCONNECTABLE MOORING SYSTEM WITH VESSEL-MOUNTED TENSIONING DEVICE

BACKGROUND OF THE INVENTION

1. Field of the Invention

This invention relates to disconnectable mooring systems for loading and offloading liquid petroleum product oil tankers, floating storage (FSO) vessels, floating production storage and offloading (FPSO) systems, floating vessels for natural gas offloading, such as cryogenic liquefied natural gas (LNG) regas import terminals, and LNG transport vessels. In particular, the invention relates to an improved buoy recovery system for a disconnectable turret mooring system that permits turret-buoy connection at any compass heading.

2. Description of the Prior Art

Floating production systems are commonly used in remote offshore locations where design constraints on production infrastructure or the harsh seas make conventional fixed production platforms impracticable. Floating production systems typically include a vessel for storage and transportation of produced oil or gas from a remote offshore well to an onshore receiving terminal. To produce the oil or gas into the storage vessel, the floating production system must be moored in some manner to the offshore well. Many mooring systems are "turret" systems of one form or another, which are familiar to those skilled in the art and will only be briefly discussed herein. The mooring turret is an assembly disposed vertically through the vessel from a position above the main deck and down through the keel. Turrets are generally very large, expansive structures having a vertical height greater than that of the vessel and usually include large diameter upper and lower bearings, such that the vessel may rotate independently about the turret. Many prior art disconnectable mooring systems also require a large (approximately 10 meters or greater diameter) cone-shaped opening in the vessel bottom. Such large turret-vessel structures are expensive to construct. Furthermore, large openings in the vessel hull constructed to accommodate disconnectable mooring buoys cause significant drag and energy losses on those cargo vessels if they are required to sail a long distance from the mooring. Newer and larger high-speed LNG carrier/regas vessels tend to have a narrow flat bottom near their bow, the optimum location for buoy connection. A large hull opening is much less desirable at that position.

Numerous prior art patents disclose prior buoy mooring systems. Several of these disclose a submerged buoy that can be detachably released from a floating vessel. In these systems, the submerged buoy typically has sufficient buoyancy so that it can be raised into contact with the vessel keel with the aid of tensioning devices and wire systems or by its own bouyant force. For example, FIG. 1 illustrates in greater detail a prior art embodiment of a buoy recovery system 101 typically disposed within a disconnectable turret mooring system 100. The mooring system 100 includes two basic parts: a geostationary buoy 160 that is detachably connected to a turret assembly 120 disposed in the floating vessel 110. The buoy 160 is moored to the seabed (not illustrated) by a number of anchor legs 162 that are connected to the buoy 160 at anchor leg connectors 164, such that the buoy 160 is generally geostationary.

The turret assembly 120 is mounted in the vessel hull 110 such that the hull can rotate about the turret in response to environmental forces of wind, waves, and currents. The hull 110 opens to the sea near the keel elevation 108. The turret assembly 120 comprises a vertical turret shaft 122 which is equipped with a hollow hydraulic connector 128 at its lower end that is designed and arranged to disconnectably mate with a connector hub 166 located at the top of the buoy 160. Rubber fenders 125 are provided at the keel 108 to cushion the mooring process. A water seal 127 is provided to maintain watertight integrity of the turret compartment in the vessel 110.

The mooring arrangement 100 of FIG. 1 provides a fluid flow path between a subsea well or component thereof and the vessel when the vessel is moored to the buoy 160. The fluid transfer system (FTS) 100 includes a geostationary flexible conductor 168, a geostationary lower conductor 170, and a vessel-fixed upper conductor 174. The flexible conductor 168 spans the distance between the seabed (not illustrated) and the buoy 160 and couples with the lower conductor pipe 170. The upper conductor pipe 174, which is fixed to the vessel, is in fluid communication with the lower conductor pipe 170 and the flexible conductor 168 via fluid swivel stack 172.

When the buoy 160 is completely separated from the vessel 110, the buoy 160 is arranged and designed to sink to a neutrally buoyant position at a depth of approximately thirty-six meters below the sea level. The vessel 110 is moored to the buoy 160 by first recovering the submerged buoy 160 upwards to the hollow hydraulic connector 128 positioned at the keel 108. A mooring tensioning assembly 132 is used to pull in the buoy 160 using a pull-in line 135 attached to the mooring chain 130 of buoy 160. The pull-in line 135 is rigged from the mooring tensioning assembly 132 through a chain tensioner 136 in the turret assembly 120 to the mooring chain 130 of buoy 160. The mooring tensioning assembly 132 pulls in the pull-in line 135 until the loading sharply increases (i.e. once the buoy 160 is within a few yards of the vessel 110). The chain tensioner 136 in the turret shaft 122 is then engaged and begins slowly pulling in the geostationary buoy 160 up to the connection position. The turret assembly 120 is rotated with respect to the vessel using hydraulic drive motors (not illustrated) until the riser tubes 170 of turret assembly 120 and the riser tubes 168 of geostationary buoy 160 are properly aligned. The hollow hydraulic connector 128 is then locked in engagement with the connector hub 166, fixing the turret 120 with the geostationary 160 and mooring the vessel 110 to the seabed (not illustrated). The vessel is free to weathervane about the geostationary turret 120 in response to wind, waves, and currents.

Large turret structures are often necessary to support the weight of the turret-mounted tensioning assembly or provide an adequate spacing in which to rig the pull-in line from a vessel-mounted tensioning assembly. As shown in FIG. 1, mounting the mooring tensioning assembly 132 on the deck 107 of the turret assembly 120 requires an increase in the size of the turret structure 120 needed to support the mooring tensioning assembly 132 and requires that the product swivel stack 172 be disposed at a high elevation above the vessel deck 109.

3. Identification of Objects of the Invention

One or more embodiments of the invention are arranged and designed to accomplish one or more of the following objects:

An object of the invention is to provide a disconnectable turret mooring system with a vessel-mounted tensioning assembly which allows for connection at any compass heading, yet prevents pull-in line engagement with turret components.

Another object of the invention is to provide a disconnectable turret mooring system wherein the turret for buoy recovery is significantly reduced in size.

Another object of the invention is to provide a disconnectable turret mooring system which permits the swivel stack assembly to be positioned within the vessel between the deck and the keel.

Another object of the invention is to provide a buoy recovery system which supports the weight of the buoy during recovery but does not adversely affect the pull-in line or mooring chain during turret-buoy piping alignment operations.

Another object of the invention is to provide a buoy recovery system which minimizes the loading on the turret structure during turret-buoy piping alignment operations.

Another object of the invention is to provide a disconnectable turret mooring system which minimizes the opening in the vessel bottom.

Another object of the invention is to provide a disconnectable turret mooring system with an integrated buoy recovery system which can retrieve and release a geostationary buoy in high sea states and harsh conditions as a result of the arrangement of the buoy-to-ship interface equipment.

Other objects, features, and advantages of the invention will be apparent to one skilled in the art from the following specification and drawings.

SUMMARY OF THE INVENTION

The objects identified above, as well as other features and advantages of the invention are incorporated in an improved buoy recovery system for a disconnectable mooring arrangement that permits turret-buoy connection at any compass heading. In a preferred embodiment, the mooring tensioning assembly is positioned at a location on the vessel other than on the rotatable turret assembly. This permits the size of the turret assembly to be significantly reduced, because a large turret structure is no longer needed to support the mooring tensioning assembly or provide the required space for the turret-mounted tensioning device to function properly. The reduced size of the turret assembly also permits both the turret assembly and the swivel stack to be positioned within the confines of the vessel (i.e., between the deck and the hull of a moon pool of the vessel).

The improved buoy recovery system employs intermediate buoy support equipment to support the weight of the buoy and to prevent damage to the turret assembly or to the pull-in line during buoy recovery operations. The intermediate buoy support equipment includes a hollow bore hydraulic cylinder assembly that is configured as a rotatable hydraulic chain jack. The hollow bore hydraulic cylinder assembly comprises a hollow bore hydraulic cylinder, a cylindrical line swivel, a bearing and a retaining device. The hydraulic cylinder is vertically mounted atop the hollow hydraulic connector of the turret assembly. The cylindrical line swivel, which also has a hollow bore for passage of the pull-in line, is disposed within the hollow bore hydraulic cylinder and is arranged and designed to create an upper and a lower annulus with the hydraulic cylinder. The cylindrical line swivel is supported within the hydraulic cylinder by a bearing disposed in the lower annulus. The bearing allows the turret and the turret-mounted hydraulic cylinder to rotate about the cylindrical line swivel, which remains substantially stationary with the geostationary buoy during mooring operations. When hydraulic fluid is pumped from a hydraulic source into the lower annulus between the hydraulic cylinder and the cylindrical line swivel, the cylindrical line swivel is raised or jacked up within the hydraulic cylinder.

The pull-in line, which is preferably a hawser but may also be a tensioning rope, wire line, or even a mooring chain, is rigged from the mooring tensioning assembly through the turret assembly at a specific initial orientation of the turret to the vessel. During buoy recovery operations, the pull-in line is preferably connected using a rope-to-chain connector to the end of a mooring chain attached to the buoy. Alternatively, the pull-in line may be attached directly to the buoy itself. The buoy is then recovered toward the vessel by pulling in the pull-in line through the turret assembly and the hydraulic cylinder assembly using the mooring tensioning assembly. When the end of the pull-in line emerges through the top of the hydraulic cylinder assembly, the retaining device coupled to the cylindrical line swivel is engaged about the pull-in line to secure the pull-in line with attached buoy to the cylindrical line swivel. This permits the weight of the buoy to be supported by the intermediate buoy support equipment rather than by the mooring tensioning assembly.

While the weight of the buoy is supported by the cylindrical line swivel of the intermediate buoy support equipment, the pull-in line above the retaining device is payed out until the cylindrical line swivel is fully retracted. When the cylindrical line swivel is in its fully retracted position, the load of the buoy is transferred directly to the bearing of the hydraulic cylinder assembly. The bearing allows the turret and hydraulic cylinder to be freely rotated about the cylindrical line swivel and buoy. The cylindrical line swivel, however, remains substantially stationary in relation to the buoy while the turret, hollow hydraulic connector and hydraulic cylinder are rotated into the proper turret-buoy piping alignment. The torsional stiffness of the pull-in line, due to the weight of the buoy, is great enough to allow operation of the bearing without causing undue twisting of the pull-in line or rotational movement of the geostationary buoy.

The buoy may be recovered to the vessel at any compass heading, because after initial buoy retrieval, the turret may be rotated up to 360 degrees relative to the buoy in order to properly align the turret piping with the buoy piping. The intermediate buoy recovery equipment supports the buoy during the alignment operation; therefore, the pull-in line is not adversely twisted or stretched while the turret is rotated. Once the turret is properly aligned with the buoy, a turret alignment pin is engaged to prevent any additional rotation of the turret with respect to the buoy. Hydraulic fluid is then pumped from a hydraulic source into the lower annulus between the hydraulic cylinder and the cylindrical line swivel to upwardly raise or jack up the cylindrical line swivel within the hydraulic cylinder. This simultaneously unloads the bearing disposed within the hydraulic cylinder assembly. The buoy, which is secured to the cylindrical line swivel through the retaining device, is raised into a position adjacent to the turret. The hollow hydraulic connector is engaged to lock the buoy to the turret at the correct orientation. The turret may then be dewatered, the turret-buoy piping connected, and ropes/chains stowed for future buoy disconnection.

BRIEF DESCRIPTION OF THE DRAWINGS

The objects, advantages, and features of the invention are described in detail hereinafter on the basis of, but not limited to, one or more embodiments illustrated in the accompanying figures, in which.

DESCRIPTION OF PREFERRED EMBODIMENTS OF THE INVENTION

Figure 1:
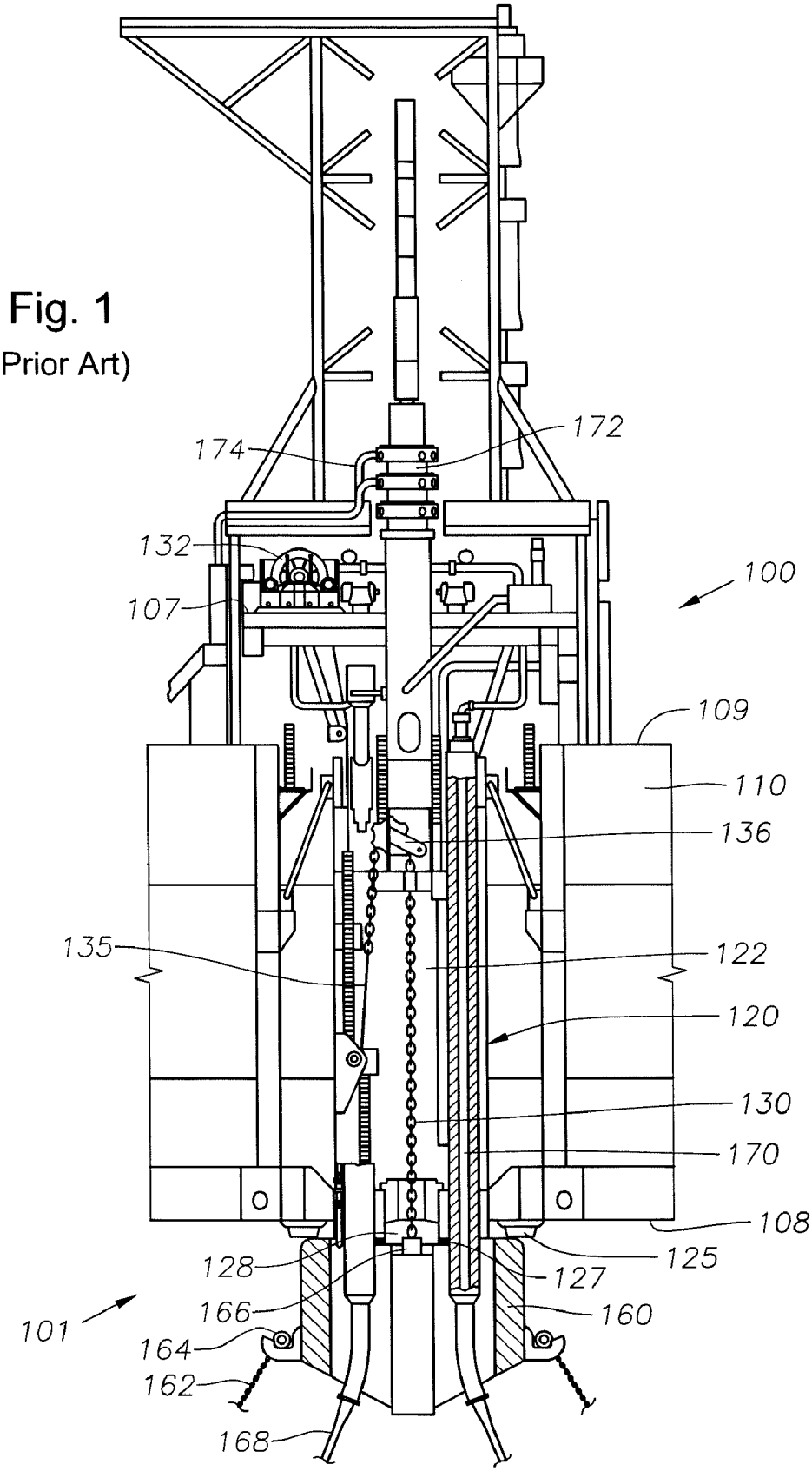
Fig. 1 (Prior Art)
FIG. 1 illustrates a side view in partial cross section of a typical prior art disconnectable mooring system with a chain jacking system and a turret-mounted tensioning assembly which shows a mooring buoy connected to the vessel.
Figure 2A:
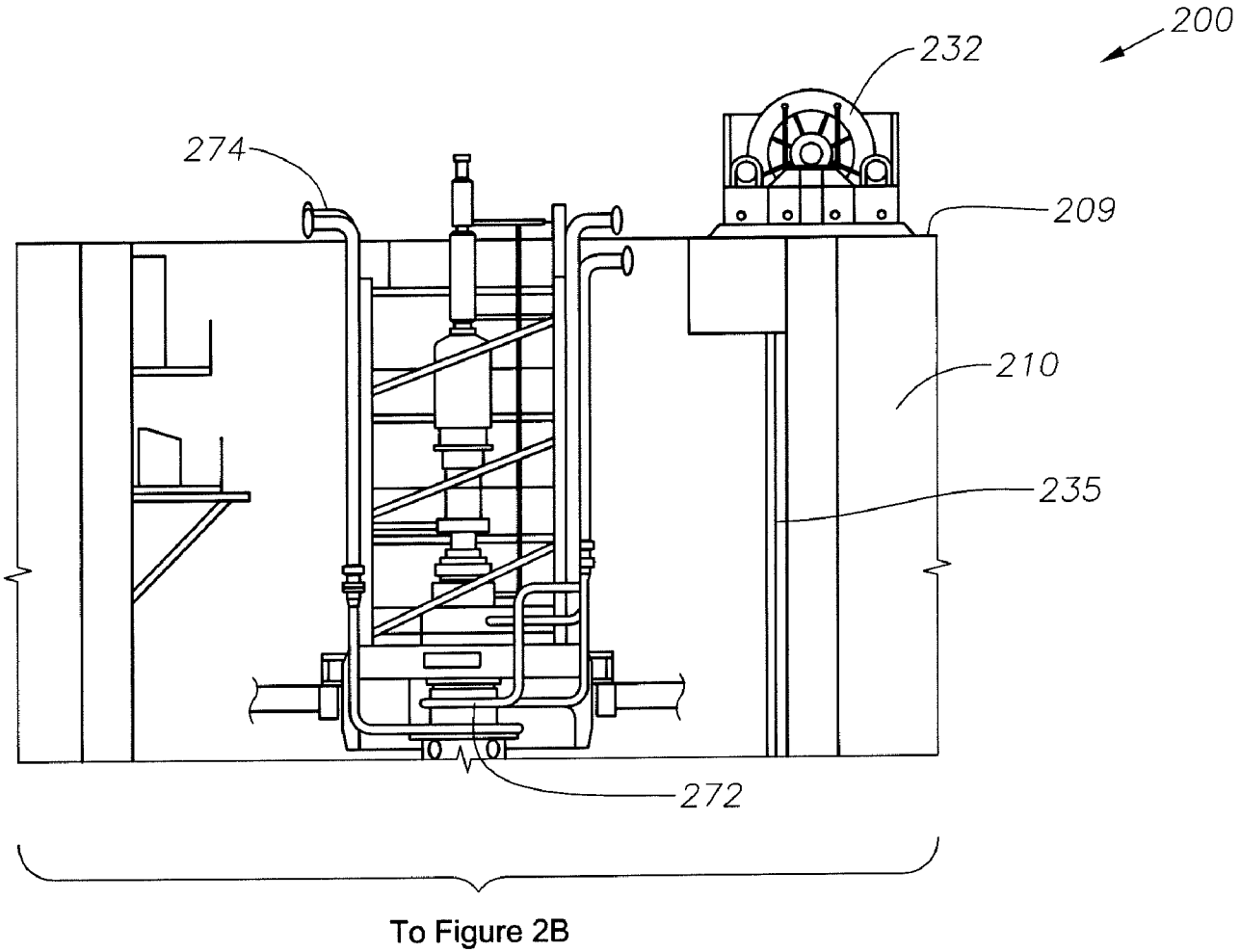
FIG. 2A illustrates a side view in partial cross section of the upper portion of a floating production system, according to an embodiment of the invention, which is moored by a disconnectable buoy.
Figure 2B:
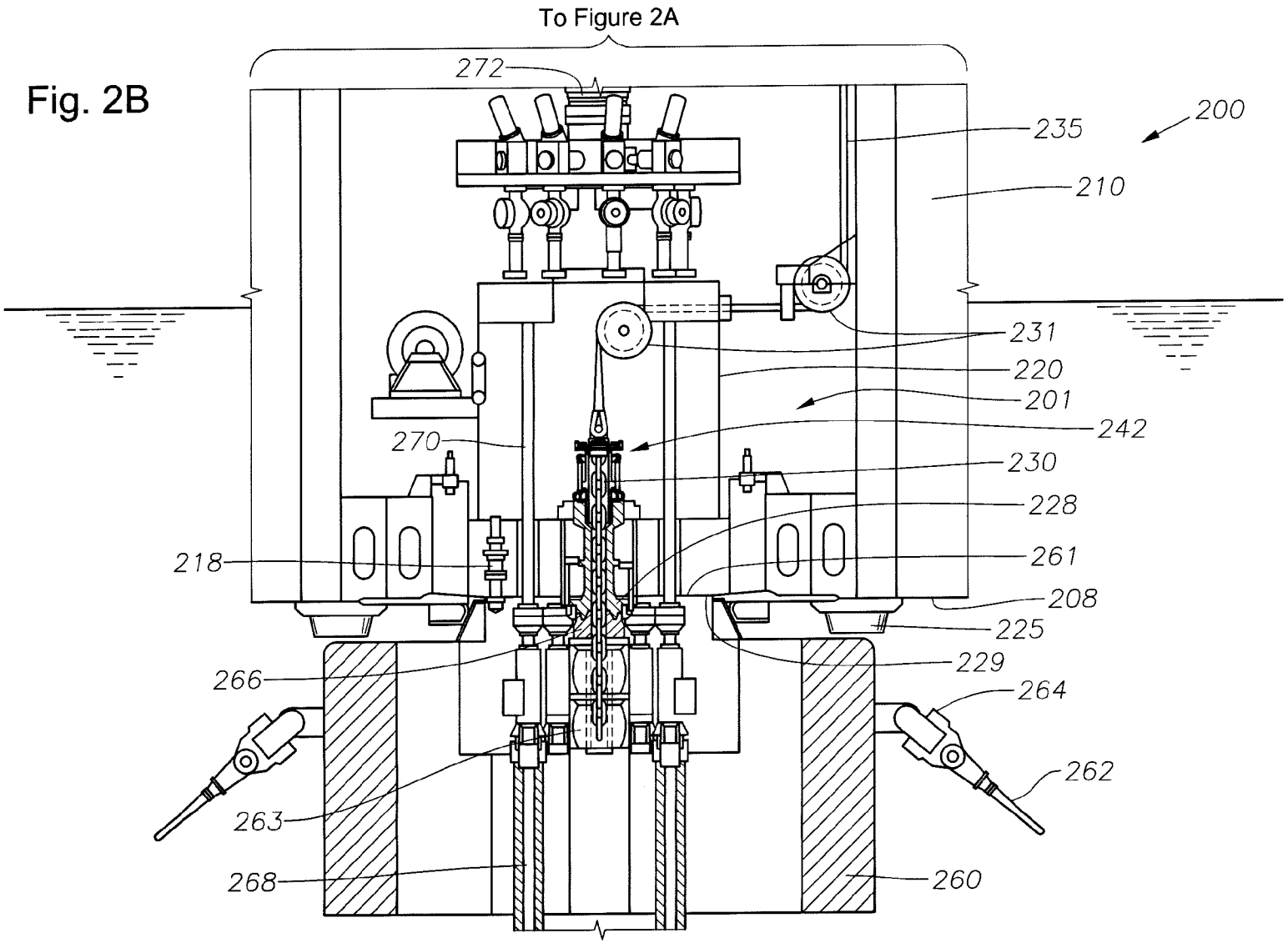
FIG. 2B illustrates a side view in partial cross section of the lower portion of the floating production system of FIG. 2A, according to an embodiment of the invention, which is moored by a disconnectable buoy.

FIGS. 2A and 2B illustrate a preferred embodiment of the invention which comprises an improved buoy recovery system 201 for a disconnectable mooring arrangement 200 that permits turret-buoy connection at any compass heading. The disconnectable mooring arrangement 200 is similar to the prior art arrangement illustrated in FIG. 1, which disconnectably moors the vessel and allows the vessel to weathervane around the point of mooring under the influence of wind, waves, and currents while the vessel is being loaded. The disconnectable mooring arrangement 200 includes a geostationary buoy 260 that is detachably connected to the turret assembly 220 through a hollow hydraulic connector 228.

As shown in FIG. 2B, the hollow hydraulic connector 228 is mounted to the bottom 229 of the turret assembly 220 and is arranged and designed to selectively connect with a cooperating hub 266 positioned on the top 261 of buoy 260. Several types of hollow hydraulic connectors are known in the art, and they each differ primarily by the various turret/buoy connection mechanisms employed. The specific connection mechanism for the hollow hydraulic connector 228 is not important to any of the disclosed preferred embodiments and thus will not be discussed further herein. After the turret is properly aligned with the buoy, hydraulically driven pins 218 disposed at the bottom 229 of the turret assembly 220 are placed in slots (not illustrated) on the top 261 of the buoy 260 to prevent further rotation and subsequent misalignment of the piping 270 of turret 220 relative to the piping 268 of buoy 260 during mooring operations. After rotational alignment, a hollow hydraulic connector 228 is locked in axial engagement with the cooperating hub 266 of buoy 260 thereby allowing the vessel 210 to freely rotate about the geostationary buoy 260.

The geostationary buoy 260 preferably includes a chain locker 263 disposed axially in the buoy 260. A mooring chain 230 is normally stowed within the chain locker 263 and is used to pull in the buoy 260 toward the hollow hydraulic connector 228 positioned at the bottom 229 of the turret 220. As is typical with most prior art mooring systems, the geostationary buoy 260 includes a number of anchors (not illustrated) and anchor legs 262 that moor the buoy 260 to the seabed (not illustrated) so that the buoy 260 remains essentially geostationary. A bumper assembly 225 is provided at the bottom 208 of the vessel 210 to absorb shocks encountered between the buoy 260 and the vessel 210 during snubbing operations. The mooring system 200 also provides a fluid flow path 268 between a subsea well, pipeline, or component thereof (not illustrated) and the vessel 210 when the vessel 210 is moored to the buoy 260. The cargo is transported to or from the vessel 210 by a pipeline on the seabed (not illustrated), a pipeline end manifold (not illustrated), a flexible conductor 268, and a fluid transfer system 270, 272, 274, located on the vessel 210. However, other fluid flow paths arrangements may be used as appropriate.

As shown in FIG. 2A, the improved buoy retrieval system includes a mooring tensioning assembly 232, such as a winch, capstan, windlass, or other tensioning device, that is preferably mounted on the deck 209 of the vessel 210 rather than on the turret assembly 220 as in the prior art system shown in FIG. 1. This permits the size of the turret assembly 220 to be reduced, as shown in FIG. 2B, because a large turret structure 220 is no longer needed to support the mooring operation or provide the required space for the turret-mounted tensioning assembly 232 to function properly. The reduced size of the turret structure also permits both the turret structure 220 and the swivel stack 272 to be positioned between the deck 209 and keel 208 of the vessel 210.

Figure 2C:
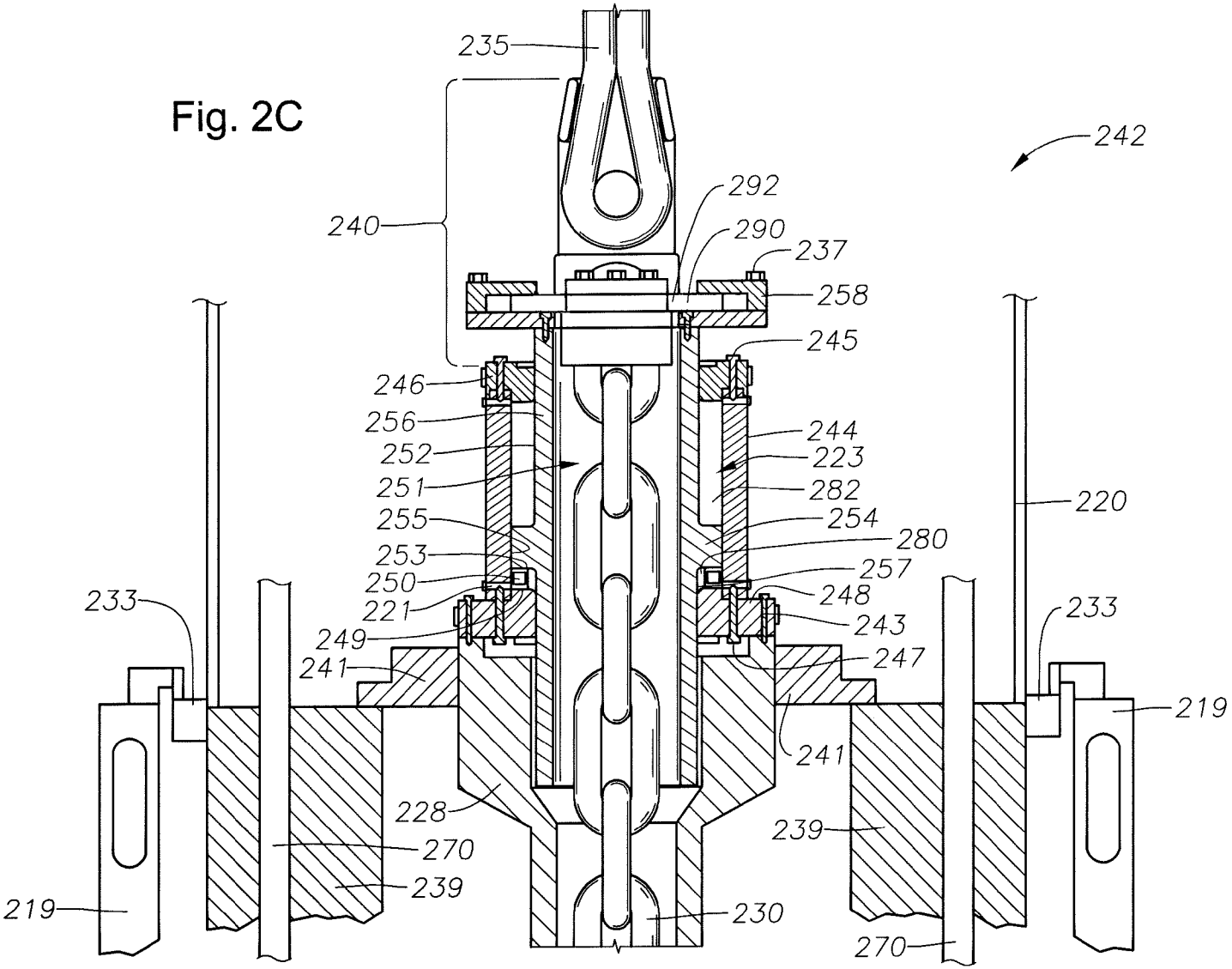
FIG. 2C illustrates a side view in cross section of the hollow bore hydraulic cylinder assembly, according to an embodiment of the invention, as mounted to the turret assembly of the floating production system shown in FIG. 2B.

The improved retrieval system 201, as shown in FIG. 2B, includes intermediate buoy support equipment 242 to support the weight of the buoy 260 and to prevent damage to the turret structure 220 or to the pull-in line 230, 235 during buoy recovery operations. As shown in FIG. 2C, the intermediate buoy support equipment is a hollow bore hydraulic cylinder assembly 242, which is configured as a rotatable hydraulic chain jack. The hydraulic cylinder assembly 242 supports the load of the buoy 260 while the turret assembly 220 is rotated into the proper turret-buoy orientation for piping alignment. Hydraulic fluid is then pumped into the hydraulic cylinder assembly 242, which acts as a rod and piston to raise or jack up the buoy to a position adjacent to the keel 208 of vessel 210. The hydraulic cylinder assembly 242 preferably comprises a hollow bore hydraulic cylinder 244, a chain swivel 252, a roller thrust bearing 250, and a retaining device 258. The hydraulic cylinder assembly 242 is vertically mounted to hollow hydraulic connector 228 using bolts 243. The hollow hydraulic connector 228 is fixed to connector support ring 239 by means of a coupling 241. The turret assembly 220, connector support ring 239, coupling 241, and hollow hydraulic connector 228 all are rotatively coupled to the vessel bottom bulkhead 219 by turret bearing 233.

As further illustrated in FIG. 2C, the hydraulic cylinder assembly 242 includes hydraulic cylinder 244, which has hollow bore 223 and which is attached at its upper end to an integral internal upper flange 246 using bolts 245 and at its lower end to integral external lower flange 248 using bolts 247. The integral external lower flange 248 is mounted on top of the hollow hydraulic connector 228 using bolts 243. On the interior side of the hydraulic cylinder 244, the integral external lower flange 248 has a lip 249, which supports roller thrust bearing 250. Chain swivel 252, preferably of a cylindrical shape and having a hollow bore 251 for passage of pull-in line 230, 235, is disposed within the hollow bore hydraulic cylinder 244 and is arranged and disposed to create an upper and a lower annulus with the hydraulic cylinder. The chain swivel 252 has a ring projection 254 near its vertical center point which extends outwardly to the hydraulic cylinder 244 and separates the lower annulus 280 and the upper annulus 282 created between the hydraulic cylinder 244 and the chain swivel 252. The ring projection 254 acts as a piston operating in the upper annulus 282 to move the upper portion 256 of chain swivel 252 upwardly within the hydraulic cylinder assembly 242. Ring projection 254 has a downwardly facing lip 253 that rests upon the roller bearing 250 so that the chain swivel 252, in its fully retracted or initial state, is supported by and rotates relative to the integral external lower flange 248 bolted to the hollow bore hydraulic cylinder 244. The ring projection 254 also has an outwardly facing lip 255 which abuts the inner wall of the hydraulic cylinder 244 and permits the chain swivel 252 to rotate within the hydraulic cylinder 244 while at the same time vertically stabilizing the chain swivel 252. The integral internal upper flange 246 attached to the top of the hydraulic cylinder 244 abuts the outer wall of the hydraulic cylinder 244 at a position above the ring projection 254 and also serves to vertically stabilize the rotating chain swivel 252.

The roller bearing 250 provides an anti-friction pivot for the hydraulic cylinder 244 to rotate about the chain swivel 252. The roller bearing 250 is disposed within the lower annulus 280, which is bounded by the interior surface 259 of the hydraulic cylinder 244, the downwardly facing lip 253 of ring projection 254, the exterior surface 257 of chain swivel 252 and the lip 249 of the integral external lower flange 248. Disposing the roller bearing 250 within the lower annulus 280 eliminates the need for an external housing and/or sealing of the bearing 250. Because roller bearing 250 is preferably submerged in hydraulic fluid disposed in the lower annulus 280 at all times, the need to lubricate roller bearing 250 is also eliminated. Hydraulic fluid is supplied to the lower annulus 280 from a hydraulic fluid source (not illustrated) via line 221. The chain swivel 252 is raised upwardly within the hydraulic cylinder 244 to its fully extended or final state when hydraulic fluid is pumped into lower annulus 280. Conversely, the chain swivel 252 is lowered downwardly within the hydraulic cylinder 244 back to its fully retracted or initial state when hydraulic fluid is evacuated from lower annulus 280. Thus, ring projection 254 acts as a piston operating within the lower annulus 280 and upper annulus 282 to raise or lower the upper portion 256 of chain swivel 252, which acts as a piston rod, in response to hydraulic fluid entering or exiting the lower annulus 280.

A retaining device 258 is secured with bolts 237 to the top of the chain swivel 252 (i.e., the top of the piston rod). The retaining device 258 preferably includes two sliding plates 290 that are adapted to slide within grooves 292 formed in the side of the rope-to-chain connector 240. During buoy recovery operations, the pull-in line 235 and/or mooring chain 230 is secured to the chain swivel 252 by sliding the retaining plates 290 into the grooves 292 of the rope-to-chain connector 240. The retaining device 258 may alternatively consist of a clamp, retaining pin, or similar mechanism to secure the rope-to-chain connector 240, the pull-in line 235, or the chain 230 to the chain swivel 252.

As shown in FIGS. 2A and 2B, a pull-in line 235, which is ideally a hawser, but may be a tensioning rope, wire line, or chain, is connected at its lower end by a rope-to-chain connector 240 (see FIG. 2C) to the mooring chain 230 attached to the buoy 260. Alternatively, the pull-in line 235 may be attached directly to the buoy 260 itself. The pull-in line 235 is rigged through the turret assembly 220 from the mooring tensioning assembly 232 to the hollow bore hydraulic cylinder assembly 242 using various sheaves 231 and/or flexible bend restrictors (not illustrated) attached to the vessel 210 and the turret assembly 220. With the pull-in line 235 rigged through the turret assembly 220, the required height of the turret assembly 220 may also be reduced. This permits the swivel stack assembly 272 to be positioned within the vessel 210 between the deck 209 and keel 208. The pull-in line 235 is tensioned using the mooring tensioning assembly 232 so that it may be pulled in or payed out through the turret assembly 220 and the hollow bore hydraulic cylinder assembly 242. Prior to retrieving the submerged buoy 260, the turret assembly 220 is rotated to a specific initial orientation relative to the vessel bottom bulkheads 219 and the vessel 210. Prior to buoy recovery, the pull-in line 235 is also rigged through the turret assembly 220 in a specific initial orientation.

As illustrated in FIG. 2C, the chain swivel 252 has a hollow bore 251 which permits passage of the pull-in line 235 and mooring chain 230 therethrough without requiring an alignment mechanism. The pull-in line 235 is preferably coupled to the mooring chain 230 of buoy 260 using a rope-to-chain connector 240. During buoy recovery operations and while the tensioning device 232 is operational, the pull-in line 235, rope-to-chain connector 240, and mooring chain 230 are pulled in through the chain swivel 252. As the mooring chain 230 emerges through the hollow bore hydraulic cylinder assembly 242, the retaining device 258 is engaged about the rope-to-chain connector 240, effectively securing the pull-in line 235, rope-to-chain connector 240, and mooring chain 230 to the chain swivel 252. Thus, through the retaining device 258, the load of the buoy 260 is effectively transferred from the pull-in line 235 and the tensioning assembly 232, through the chain swivel 252, and to the roller bearing 250. Alternatively, the retaining device 258 may be engaged directly about the pull-in line 235 or the mooring chain 230 to effectively secure the buoy 260 to the chain swivel 252.

In operation, the pull-in line 235, as shown in FIGS. 2A and 2B, is rigged from the mooring tensioning assembly 232 through the turret structure 220 at a specific orientation of the turret 220 to the vessel 210. Recovery of the geostationary buoy 260 toward the vessel 210 is initiated through the use of a messenger line system (not illustrated). After the buoy mooring chain 230 is retrieved from the chain locker 263 of the buoy 260 using the messenger line (not illustrated), the pull-in line 235 is connected to the buoy mooring chain 230 with a rope-to-chain connector 240. The buoy 260 is then moved toward and preferably within about one-half meter of the vessel 210 by pulling in the pull-in line 235 through the turret structure 220 using the mooring tensioning assembly 232. When the short section of chain 230 emerges through the top of the hydraulic cylinder assembly 242, as shown in FIG. 2C, the two sliding plates 290 of retaining device 258 are inserted into grooves or slots 292 formed in the rope-to-chain connector 240. This secures the mooring chain 230 and the buoy 260 to the cylindrical chain swivel 252 and permits the weight of the buoy 260 to be supported by the chain swivel 252, hydraulic cylinder 244, hollow hydraulic connector 228, and the hollow hydraulic connector support ring 239 rather than by the mooring tensioning assembly 232. The roller bearing 250 allows the turret 220 and turret-mounted hydraulic cylinder 244 to rotate about the chain swivel 252 and buoy 260.

Once the rope-to-chain connector 240 is secured to the chain swivel 252 using the retaining device 258, any tension in the pull-in line 235 above the rope-to-chain connector 240 is released by paying out the pull-in line 235 from the mooring tensioning assembly 232 until the rope-to-chain connector 240 is seated on the retaining device 258 and/or the chain swivel 252 is fully retracted. When the chain swivel 252 is in its fully retracted or initial position, the load of the buoy 260 is transferred directly to the roller bearing 250. The roller bearing 250 allows the turret 220 and turret-mounted hydraulic cylinder 244 to be freely rotated about the chain swivel 252 and buoy 260. The chain swivel 252, however, remains substantially stationary in relation to the buoy 260 while the turret 220, hollow hydraulic connector 228, and hydraulic cylinder 244 are rotated into the proper turret-buoy piping alignment. The torsional stiffness of the pull-in line 235 and/or chain 230, due to the weight of the connected buoy 260, is great enough to allow rotation of the turret 220 and turret-mounted hydraulic cylinder 244 about the roller bearing 250 without causing undue twisting of the pull-in line 235 and/or chain 230 or rotational movement of the geostationary buoy 260.

Thus, the buoy 260 may be recovered to the vessel 210 at any compass heading, because after initial buoy retrieval, the turret 220 may be rotated up to 360 degrees relative to the buoy 260 in order to properly align the turret piping 270 with the buoy piping 268. The intermediate buoy recovery equipment 242 supports the buoy 260 during the alignment operation; therefore, the pull-in line 235 is not adversely twisted or stretched while the turret 220 is rotated. Once the turret 220 is properly aligned with the buoy 260, a turret alignment pin 218 is placed between the bottom 229 of the vessel 210 and the top 261 of the buoy 260 to prevent any additional rotation of the turret 220 with respect to the buoy 260. The intermediate buoy recovery equipment 242 then acts as a rod and piston to raise the buoy 260 into a position adjacent to the keel 208 of vessel 210. Hydraulic fluid is pumped from a source (not illustrated), through line 221, and into the lower annulus 280 housing roller bearing 250. The hydraulic fluid entering lower annulus 280 raises the ring projection 254 of chain swivel 252, which acts as a piston to raise the upper portion 256 of chain swivel 252 (i.e., the piston rod) into a final, extended position. This rod and piston action simultaneously unloads the roller bearing 250 within the lower annulus 280 and raises the buoy 260, which is attached to chain swivel 252 through retaining device 258. In a preferred embodiment, the chain swivel 252 is capable of being raised at least one meter by the hydraulic fluid pumped into the lower annulus 280. A hollow hydraulic connector 228 is engaged to lock the buoy 260 to the turret 220 at the correct piping orientation. The turret 220 may then be dewatered, the turret-buoy piping 268, 270 connected, and ropes 235/chains 230 stored for future buoy disconnection.

The Abstract of the disclosure is written solely for providing the United States Patent and Trademark Office and the public at large with a way to determine quickly from a cursory reading the nature and gist of the technical disclosure, and it represents one implementation of the invention and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. An apparatus for orienting riser pipes (268) of a disconnectable buoy (260) with corresponding riser pipes (270) of a vessel (210), said apparatus comprising:

a hydraulic cylinder (244) connected to support members (228, 239, 241) of a turret (220) which is rotatively coupled to said vessel (210), said hydraulic cylinder (244) having a bore (223) therein and having a line swivel (252) rotatively supported by a bearing (250) within said bore (223), a pull-in line (230, 235) connected to said buoy (260) and extending through said line swivel (252) and said hydraulic cylinder (244) to a pull-in line tensioning device (232), and a retaining device (258) coupled to said line swivel (252) and arranged and designed to prevent downward movement of said pull-in line (230, 235), thereby transferring the load of said buoy (260) from said tensioning device (232) to said retaining device (258), said line swivel (252), said hydraulic cylinder (244) and said support members (228, 239, 241), whereby said turret (220) can be rotated with respect to said buoy (260) to align said vessel riser pipes (270) with said buoy riser pipes (268).

2. The apparatus of claim 1 wherein, said bearing (250) is a roller thrust bearing which is arranged and designed to rotatively support said line swivel (252) with respect to said hydraulic cylinder (244).

3. The apparatus of claim 1 further comprising, a swivel stack (272) which is disposed within said vessel (210) between its deck (209) and keel (208) and which remains fixed above said turret (220) while said riser pipes (268) of said disconnectable buoy (260) are oriented with the corresponding riser pipes (270) of said vessel (210).

4. The apparatus of claim 1 wherein, said pull-in line (230, 235) has a torsional stiffness which resists torque applied thereto by the rotation of said turret (220) relative to said line swivel (252) such that said line swivel (252), said pull-in line (230, 235), and said disconnected buoy (260) remain substantially rotatively stationary in response to said torque.

5. The apparatus of claim 1 further comprising, a turret alignment pin (218) arranged and designed for placement between the bottom (229) of the vessel (210) and the top (261) of the buoy (260) to properly align said vessel riser pipes (270) with said buoy riser pipes (268).

6. The apparatus of claim 1 wherein, said retaining device (258), coupled to said line swivel (252), comprises at least one plate (290) which slides into a corresponding groove (292) on a connector (240) attached to said pull-in line (230, 235) so that downward movement of said pull-in line (230, 235) is prevented and the load of said disconnectable buoy (260) is transferred from said tensioning device (232) to said retaining device (258) and said line swivel (252).

7. The apparatus of claim 1 further comprising, a source of hydraulic fluid which is directed into said hydraulic cylinder (244) through a hydraulic fluid line (221) to upwardly raise said line swivel (252) so as to upwardly raise said buoy (260) into a position adjacent to said turret (220) for connection of said buoy (260) to said turret (220).

8. An apparatus for recovering a disconnectable buoy (260) to a vessel (210) having a turret (220) rotatively mounted to a support structure (239) at the bottom (208) of said vessel (210), comprising:

a hollow hydraulic connector (228) which is mounted at the lower end of said turret (220) and which is arranged and designed to connect to a cooperating hub (266) on the top (261) of said disconnectable buoy (260), a hydraulic cylinder (244) having a hollow bore (223) and carried by said hollow hydraulic connector (228), said hydraulic cylinder (244) having a line swivel (252) rotatively supported within said hollow bore (223) of said hydraulic cylinder (244), a source of hydraulic fluid arranged to supply pressurized hydraulic fluid to said line swivel (252) to selectively raise said line swivel (252) within said hydraulic cylinder (244), a pull-in line (230, 235) arranged to connect with said buoy (260) and to extend through said line swivel (252) to a pull-in line tensioning device (232), and a retaining device (258) coupled to said line swivel (252) and arranged and designed to selectively prevent downward movement of said pull-in line (230, 235) when engaged about said pull-in line (230, 235), whereby, when said disconnectable buoy (260) is raised near the bottom (208) of said vessel (210) by pulling in said pull-in line (230, 235) through said line swivel (252) and when said retaining device (258) engages said pull-in line (230, 235), the load of said disconnectable buoy (260) is transferred from said pull-in line tensioning device (232) to said retaining device (258), said line swivel (252), said hydraulic cylinder (244), and said hydraulic connector (228), such that said hydraulic cylinder (244) and said hydraulic connector (228) can rotate with respect to said line swivel (252) and said buoy (260) when said turret (220) is rotated with respect to said vessel (210), thereby allowing alignment of riser pipes (270) on said vessel (210) with riser pipes (268) on said buoy (260), and whereby, when said riser pipes (270) on said vessel (210) and said riser pipes (268) on said buoy (260) are aligned, hydraulic fluid is directed into said hydraulic cylinder (244) to upwardly raise said line swivel (252), thereby raising said buoy upwardly to said vessel (210) for connection of said hydraulic connector (228) with said cooperating hub (266) of said disconnectable buoy (260).

9. The apparatus of claim 8 further comprising, a bearing (250) disposed within the hollow bore (223) of said hydraulic cylinder (244), said bearing (250) arranged and designed to rotatively support said line swivel (252) with respect to said hydraulic cylinder (244).

10. The apparatus of claim 8 further comprising, a swivel stack (272) which is disposed within said vessel (210) between its deck (209) and keel (208) and which remains fixed above said turret (220) while said buoy (260) is recovered to said vessel (210).

11. The apparatus of claim 8 wherein, said pull-in line (230, 235) has a torsional stiffness which resists torque applied thereto by the rotation of said turret (220) relative to said line swivel (252) such that said line swivel (252), said pull-in line (230, 235), and said disconnected buoy (260) remain substantially rotatively stationary in response to said torque.

12. The apparatus of claim 8 further comprising, a turret alignment pin (218) arranged and designed for placement between the bottom (229) of the vessel (210) and the top (261) of the buoy (260) to properly align said riser pipes (270) on said vessel (210) with said riser pipes (268) on said buoy (260).

13. The apparatus of claim 8 wherein, said retaining device (258), coupled to said line swivel (252), comprises at least one plate (290) which slides into a corresponding groove (292) on a connector (240) attached to said pull-in line (230, 235) so that downward movement of said pull-in line (230, 235) is prevented and the load of said disconnectable buoy (260) is transferred from said pull-in line tensioning device (232) to said retaining device (258) and said line swivel (252).

14. A method for connecting a submerged buoy (260) to a floating vessel (210) having a turret (220), said method comprising the steps of:

rigging a pull-in line (230, 235) from a vessel-mounted tensioning device (232) through a hydraulic cylinder (244) which is mounted on said turret (220) and has a hollow bore (223) and through a line swivel (252) which is rotatively supported by a bearing (250) within said hollow bore (223) of said hydraulic cylinder (244);

connecting said pull-in line (230, 235) to said buoy (260);

operating said tensioning device (232) to pull in said pull-in line (230, 235) through said hydraulic cylinder (244) and said line swivel (252), thereby pulling said buoy (260) toward said vessel (210);

engaging a retaining device (258) about said pull-in line (230, 235) when said buoy (260) is pulled near said vessel (210), said retaining device (258) attached to said line swivel (252) and arranged and designed to prevent downward movement of said pull-in line (230, 235), thereby transferring the load of said buoy (260) from said tensioning device (232) to said line swivel (252) and said turret-mounted hydraulic cylinder (244); and rotating said turret (220) so that said turret-mounted hydraulic cylinder (244) rotates relative to said vessel (210) and to said line swivel (252) to properly align piping (270) on said turret (220) with piping (268) on said buoy (260).

15. The method of claim 14 wherein, said pull-in line (230, 235) has a torsional stiffness which resists torque applied thereto by the rotation of said turret-mounted hydraulic cylinder (244) relative to said line swivel (252) such that said line swivel (252), said pull-in line (230, 235), and said disconnected buoy (260) remain substantially rotatively stationary in response to said torque.

16. The method of claim 14 further comprising the step of, permitting said pull-in line (230, 235) to pay out from said tensioning device (232) as said turret-mounted hydraulic cylinder (244) is rotated relative to said line swivel (252) and said vessel (210).

17. The method of claim 14 further comprising the step of, placing a turret alignment pin (218) between the bottom (229) of the vessel (210) and the top (261) of the buoy (260) to properly align said piping (270) on said vessel (210) with said piping (268) on said buoy (260).

18. The method of claim 14 further comprising the step of, supplying pressurized hydraulic fluid to said line swivel (252) to selectively raise said line swivel (252) within said hydraulic cylinder (244).

19. An apparatus for recovering a disconnectable buoy (260) to a vessel (210) having a deck (209) and a keel (208), said apparatus comprising:

a turret (220) rotatively mounted to a support structure (239) at the bottom (208) of said vessel (210), said turret (220) disposed within said vessel (210) between said deck (209) and said keel (208), a fluid swivel stack (272) immovably mounted to said turret (220) and disposed within said vessel (210) between said turret (220) and said vessel deck (209);

a mooring tensioning assembly (232) mounted to said vessel deck (209) and arranged and designed to pull the load of said disconnectable buoy (260);

a hollow hydraulic connector (228) which is mounted at the lower end of said turret (220) and which is arranged and designed to connect to a cooperating hub (266) on the top (261) of said disconnectable buoy (260), a hydraulic cylinder (244) having a hollow bore (223) and carried by said hollow hydraulic connector (228), said hydraulic cylinder (244) having a line swivel (252) rotatively supported within said hollow bore (223) of said hydraulic cylinder (244), a pull-in line (230, 235) arranged to connect with said disconnectable buoy (260) and to extend through said line swivel (252) to said mooring tensioning assembly (232) mounted to said vessel deck (209), a retaining device (258) coupled to said line swivel (252) and arranged and designed to selectively prevent downward movement of said pull-in line (230, 235), thereby transferring the load of said disconnectable buoy (260) from said mooring tensioning assembly (232) to said retaining device (258), said line swivel (252), said hydraulic cylinder (244), and said turret (220), whereby said turret (220) and said hydraulic cylinder (244) can be rotated with respect to said line swivel (252) and said disconnectable buoy (260) to align riser pipes (270) of said turret (220) and said fluid swivel stack (272) with riser pipes (268) of said disconnectable buoy (260), and a source of hydraulic fluid arranged to supply pressurized hydraulic fluid to said line swivel (252) to selectively raise said line swivel (252) within said hydraulic cylinder (244), thereby raising said disconnectable buoy upwardly to said vessel (210) for connection of said hydraulic connector (228) with said cooperating hub (266) of said disconnectable buoy (260).

20. The apparatus of claim 19 further comprising, a bearing (250) disposed within the hollow bore (223) of said hydraulic cylinder (244), said bearing (250) arranged and designed to rotatively support said line swivel (252) with respect to said hydraulic cylinder (244).

21. The apparatus of claim 19 wherein, said pull-in line (230, 235) has a torsional stiffness which resists torque applied thereto by the rotation of said turret (220) relative to said line swivel (252) such that said line swivel (252), said pull-in line (230, 235), and said disconnected buoy (260) remain substantially rotatively stationary in response to said torque.

22. The apparatus of claim 19 further comprising, a turret alignment pin (218) arranged and designed for placement between the bottom (229) of the vessel (210) and the top (261) of the buoy (260) to properly align said riser pipes (270) of said turret (220) and said fluid swivel stack (272) with said riser pipes (268) of said disconnectable buoy (260).

23. The apparatus of claim 19 wherein, said retaining device (258), coupled to said line swivel (252), comprises at least one plate (290) which slides into a corresponding groove (292) on a connector (240) attached to said pull-in line (230, 235) so that downward movement of said pull-in line (230, 235) is prevented and the load of said disconnectable buoy (260) is transferred from said mooring tensioning assembly (232) to said retaining device (258) and said line swivel (252).

* * * * *